US005083722A

United States Patent [19]

Briggs et al.

[11] Patent Number: 5,083,722

[45] Date of Patent: Jan. 28, 1992

[54] EQUIPMENT HANDLER

[75] Inventors: Warren Briggs, Corby; Jonathan C. Booty, Oakham, both of England

[73] Assignee: Briggs Irrigation (UK) Limited, Corby, England

[21] Appl. No.: 475,534

[22] Filed: Feb. 6, 1990

[30] Foreign Application Priority Data

Feb. 7, 1989 [GB] United Kingdom ..... 8902658

[51] Int. Cl.[5] ..... B65H 75/40

[52] U.S. Cl. ..... 242/86.5 R

[58] Field of Search ..... 242/86.5 R, 86.7, 86.8, 242/106, 68.1, 129.7, 129.5, 54 R, 86.2

[56] References Cited

U.S. PATENT DOCUMENTS

| | | | |
|---|---|---|---|
| 2,692,092 | 10/1954 | Kinsinger | 242/86.5 R |
| 3,159,368 | 12/1964 | Ahlbin et al. | 242/86.5 R X |
| 3,627,224 | 12/1971 | Diggs | 242/54 R |
| 3,863,859 | 2/1975 | Keith | 242/86.5 R X |
| 4,012,002 | 3/1977 | McDonald et al. | 242/54 R |
| 4,148,445 | 4/1979 | Reynolds et al. | 242/86.5 R |
| 4,447,013 | 5/1984 | Sandered et al. | 242/54 R |
| 4,454,999 | 6/1984 | Woodruff | 242/86.5 R |
| 4,744,696 | 5/1988 | Vidler | 242/86.5 R |

*Primary Examiner*—John M. Jillions

*Attorney, Agent, or Firm*—Lowe, Price, LeBlanc & Becker

[57] ABSTRACT

The invention relates to a device for handling an elongate flexible member such as a hose, comprising a reel device for paying in and retrieving the hose, a carrier means for the reel device, and mounting means whereby the reel device is mountable on and demountable from the carrier means, there also being separate roller members in the form of outrigger arms which include rollers and which are respectively adapted for paying out and retrieving the hose. There is a motor means such as a hydraulic motor whereby the reel is rotated via the carrier so that the hose is paid out or retrieved, the reel being mounted and demounted from the carrier by a single operation with the aid of lifting tackle such as a crane.

12 Claims, 4 Drawing Sheets

EQUIPMENT HANDLER

TECHNICAL FIELD

The invention relates to an equipment handler, for example a device for handling an elongate flexible member such as a hose.

DISCLOSURE OF THE INVENTION

According to the invention there is provided a device for handling an elongate flexible member, comprising a reel device from which reel device an elongate flexible member is paid out and/or onto which it is rewound, and mounting means for the reel device whereby the reel device may be mounted on and demounted from a carrier therefor.

The mounting means may comprise spigot means on a part of the carrier and socket means in a part of the reel device.

The spigot means may comprise three spaced apart spigots with enlarged heads and the socket means may comprise orifices in which the heads at least are receivable.

The spigots may be mounted on a drive device for powered operation of reel device.

The drive device may be a plate driven by a motor which may be mounted on the carrier.

There may be means to pay out and to retrieve or wind in the member, mounted on the carrier.

A device embodying the invention is hereinafter described, by way of example, with reference to the accompanying drawings.

BEST MODE FOR CARRYING OUT THE INVENTION

Figure 1:
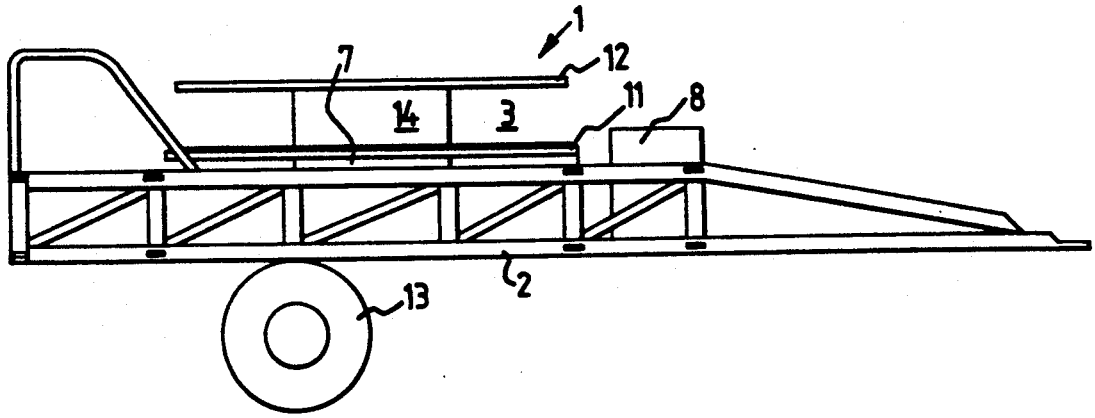
FIG. 1 is a side elevational view of one device according to the invention for laying out and retrieving an elongate flexible member in the form of a hose.
Figure 2:
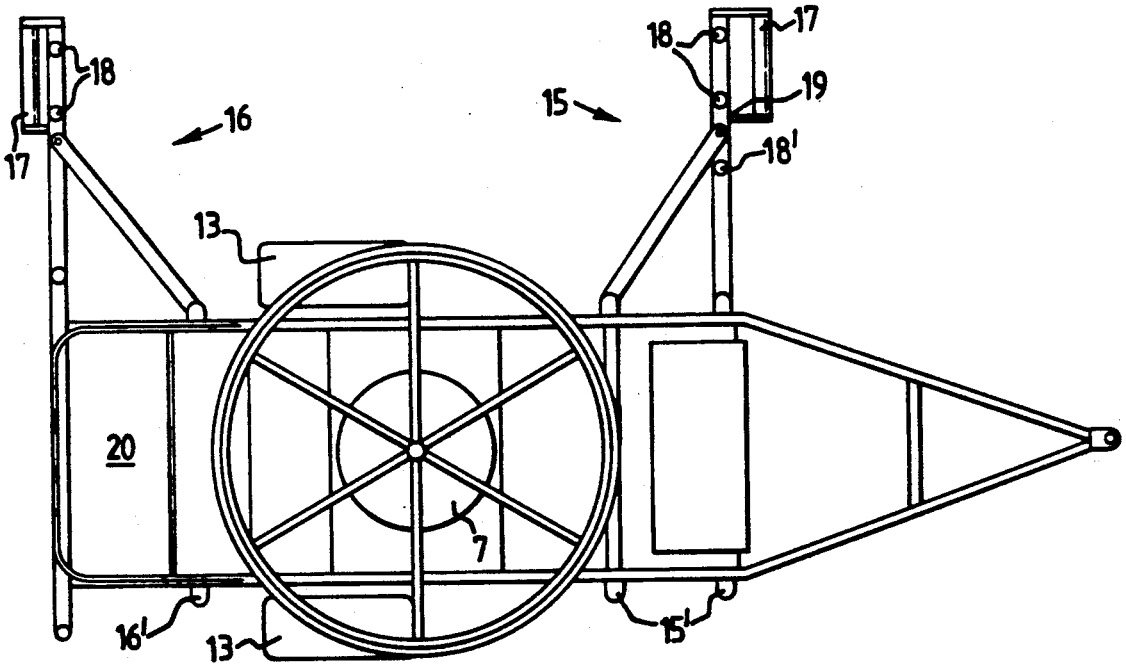
FIG. 2 is a plan view of the device of FIG. 1.
Figure 3:
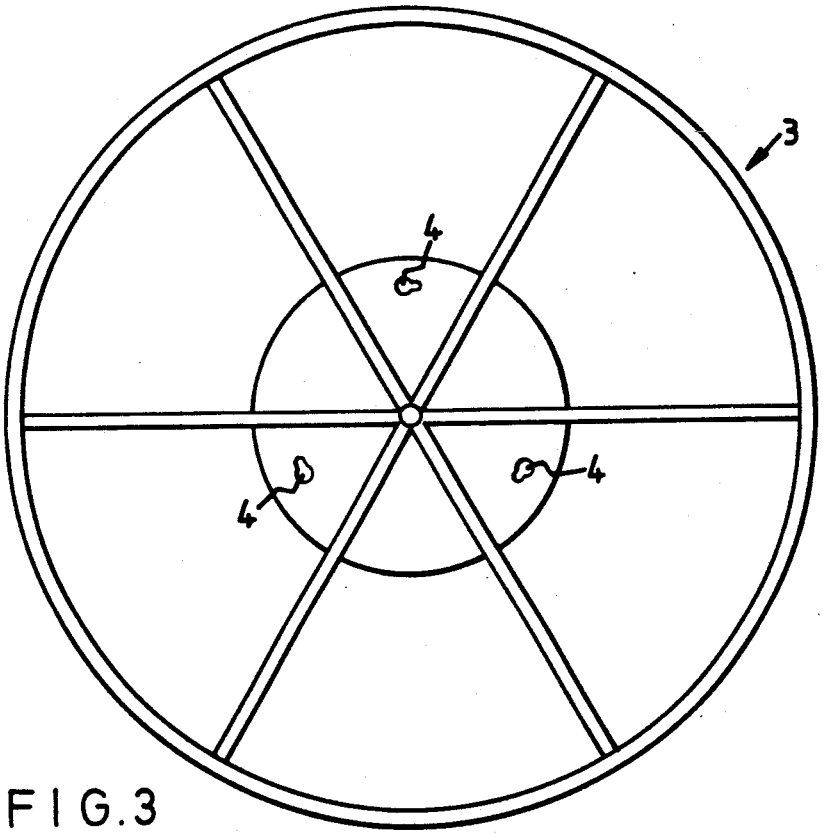
FIG. 3 is a plan view of a reel of the device.
Figure 4:
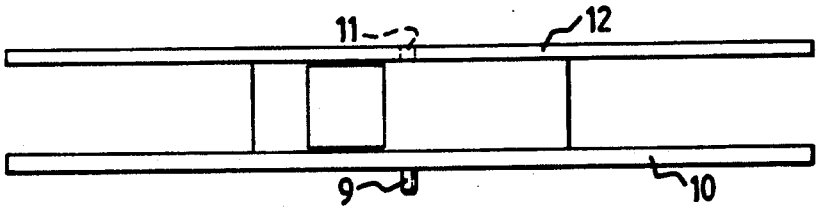
FIG. 4 is a side elevational view of the reel of FIG. 3.
Figure 5A:
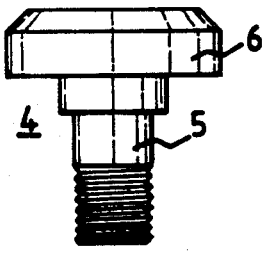
FIGS. 5*a*–5*c* are respectively end, side and bottom plan views of locking studs of the device.
Figure 5B:
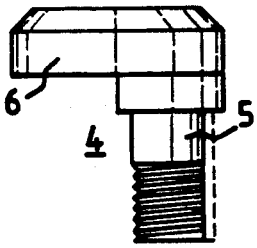
Figure 5C:
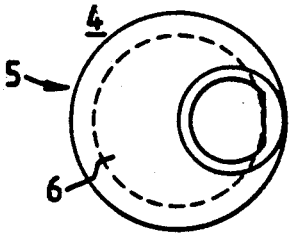

Referring to the drawings, in which like parts are referred to by like reference numerals, there is shown in FIGS. 1–5*c* a device 1 for handling an elongate flexible member such as a hose, comprising a chassis 2, means in the form of a reel 3 mounted on the chassis 2, and mounting means 4 for the reel 3 whereby the reel 3 is removably mountable on the chassis 2 which is in the form of a carrier for the reel device.

The mounting means 4 comprise a plurality, in the embodiment three, of equiangularly (120° spacing) spaced apart spigots 5 with enlarged eccentric heads 6 protruding from a drive plate 7 on the chassis 2, the drive plate 7 being driven by an on-board (in the embodiment) motor device 8 to turn the plate 7 clockwise or anti-clockwise as desired for paying out or winding in (retrieving) the hose. The reel 3 has three equiangularly spaced orifices, forming a complementary part of the mounting means 4, of key-hole configuration which receive the enlarged heads 6 of the spigots 5 whereby the reel 3 can be mounted on or demounted from the chassis 2 by a twisting and locking or unlocking action.

Each reel 3 has a central depending (as viewed) spigot or lug 9 on one flange 10 and a central blind hole or boss 11 in the other flange 12 whereby reels 3 can be stacked vertically (as viewed) one on another on the chassis 2 which is able to travel over the ground on wheels 13 (or on skids).

The reels 3 are able to be located and locked on the drive plate 7 by a simple two action movement performed by one person with the help of lifting tackle such as a crane. As shown there are three positions to secure the reel at 120° intervals. Three types of reels are proposed depending on hose length and shipping requirements, all incorporating a large drum center which 1) aids hose life with minimum bend radius
2) reduces wind-in speed variation
3) increases base size which aids interchanging and stacking for transport.

The hub center 14 is designed for easy positioning and removal of the inner hose end with the outer hose end being secured to the outer reel.

There are hose layout and retrieval means in the form of respective roller box arms 15 and 16 mounted on the left side of the chassis 2 so laying the hose two meters from the vehicle center line. This provides for optimum driver visibility and control. Both arms 15, 16 are fully adjustable and fold into the chassis 2 for normal road travel. They are also interchangeable for mounting on the right hand side if necessary, where there are suitable mounting lugs 15' and 16'.

The roller arms 15 and 16 each comprise one horizontal roller 17 and two vertical rollers 18 which completely encase the hose eliminating any possibilities of snags, cuts or dangerous movement during retrieval.

The forward (retrieval) roller arm 15 has an adjustable preload roller 18' which tensions the hose up to a maximum of 0.9 tons ensuring a consistent tight lay on each reel. A hinged top arm 19 on the roller box 15 eases the manual loading operation at the start of each reel.

The trailing (pay- or layout) arm 16 is completely free wheeling with retardation being controlled on a reel brake. The horizontal 17 and vertical rollers 18 are completely adjustable allowing maximum variations depending on operation heights, wind-in speed preloads etc. This would only need to be adjusted during commissioning.

The chassis 2 or base frame, is sized to suit respective trucks and trailers.

The bottom reels locate on their central spigot and are securely clamped by clamps in four positions on the outer rim. The next layer of reels are also located on the central spigot and clamped by further clampss in such a way as to secure the outer rims to the lower reel as well as space the upper rims.

For coiling the hose into quadrangular boxes, hoses are transferred from a standard retrieval reel to a spoke center reel which can dismantle from the top. The hose is transferred from the standard reel on a skid mounted braked hub to the spoke center reel driven on the retrieval unit. When the hose is fully wound on the spoke center reel the complete unit is lifted off the drive plate as per standard reel changing.

The top and spoke center is then lifted off the lower base and rim and the hose is strapped in four positions. It iss then possible to slide and lower the hoses into boxes. The reverse operation is performed to assemble the hoses back onto standard reels.

Each reel 3 weighs about 280 kg and each hose weighs about 400 kg, ranging in size from 100 m×5 cm to 300 m×12.5 cm. The complete reel/hose assembly can be removed and replaced within about five minutes using one operative.

Moreover, the chassis 2, in operation, picks up the hose from the ground on which it is laid whilst travelling forward, and does not drag the hose on the ground, the pre-load necessary to ensure that the hose is wound tightly on the reel being controlled by the roller system described.

The chassis 2 shown is strong and shallow to keep the reel 3 as low to the ground as possible which eases the hose feed and reel interchanging maximising safety.

For these reasons the chassis 2 is in another embodiment designed to allow adaptation to a towed trailer with a solid mounted, braked single axle on flotation tires.

This embodiment adds minimal cost and increases options when testing and commissioning in desert conditions. The complete unit is of galvanised finish for maximum corrosion resistance and long life.

A diesel hydraulic powerpack 8 can be integral with the device, or separate. It will mount down as per a generator pack.

Power is provided via a 22 kW Deutz F2L511 diesel engine operating at 2400 rpm (17 kW) coupled to a Danfoss variable displacement pump. Torque available at the reel center is 450 daNm.

Drive is transmitted via a 7:1 planetary hub assembly which gives a good hydraulic R.P.M. range as weel as a completely encapsulated gearbox.

Relief valve operation is available across the complete hydraulic range and can be pre-set up to maximum available torque.

The reel speed range is from 0 r.p.m. to 60 r.p.m., preferably 2 r.p.m. to 27 r.p.m., with 10 r.p.m. being optimum. At this speed the hose rewind time should be between five to seven minutes per 200 m length. This allows five minutes per reel change to be within a minimum 1 km per hour requirement. The operator is positioned at 20 at the rear of the device 1 to maximize safety and visibility.

Controls are as follows:

1) Hydrostatic control lever for start and speed.

2) Selector lever—with which either drive, neutral or brake is engaged ensuring drive cannot be engaged whilst the brake is on.

Figure 6:
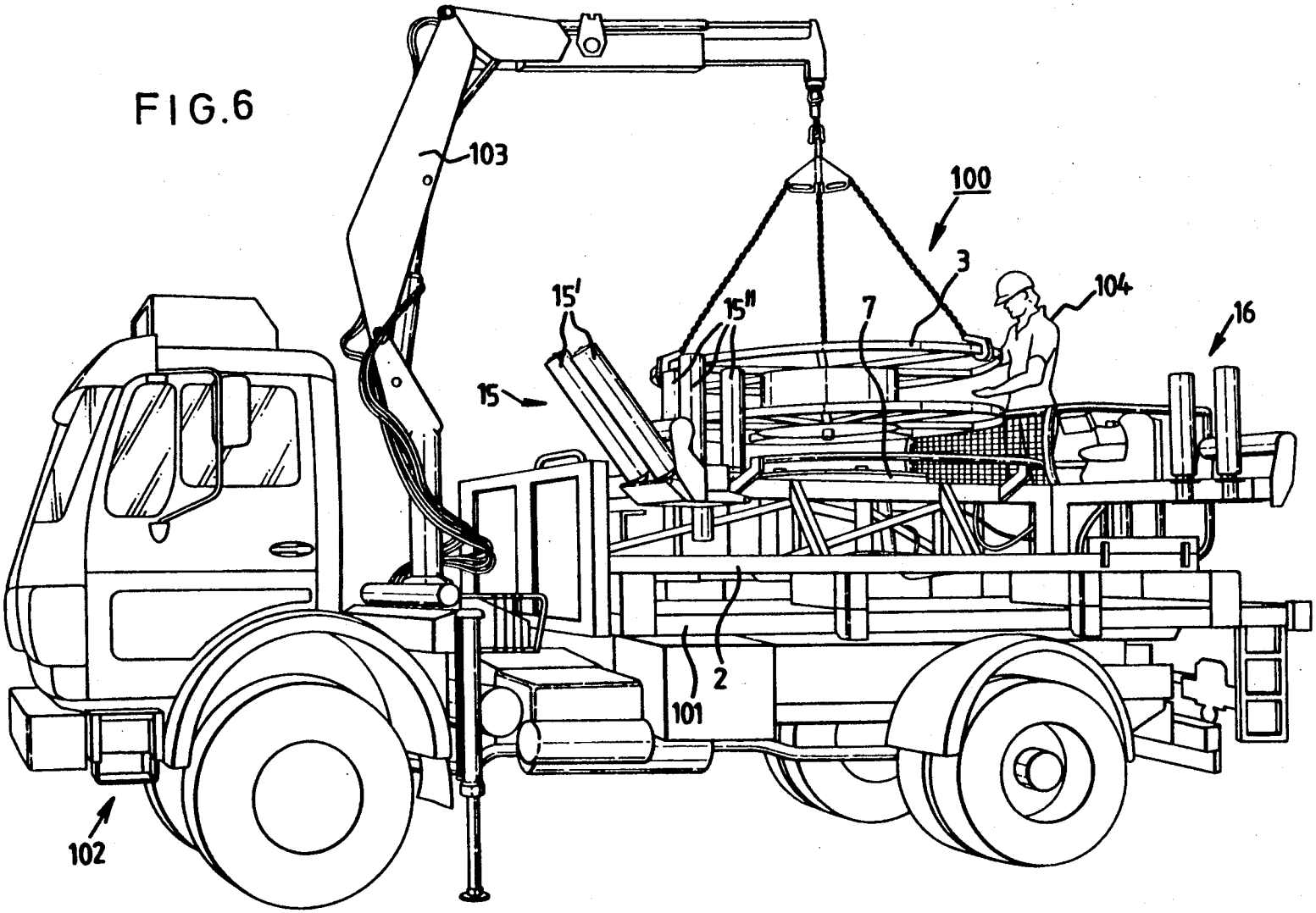
FIG. 6 is a side elevational view of a second device according to the invention shown mounted on a carrying platform of a self-loading lorry or truck.
Figure 7:
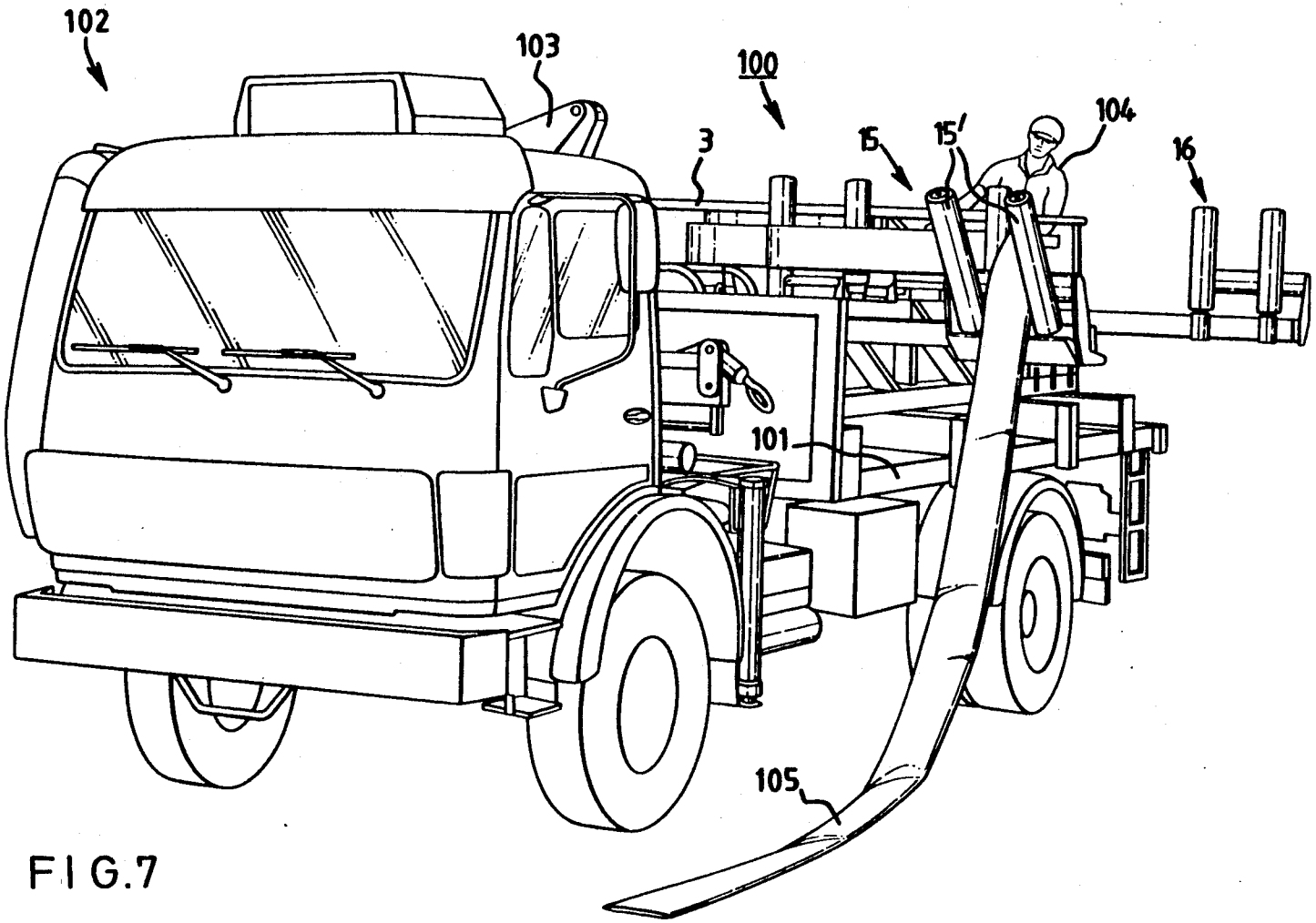
FIG. 7 is a perspective view of the device of FIG. 6 in use in a mode for retrieving an elongate flexible member in the form of a hose.

Referring now to the embodiment of device 100 shown in FIGS. 6 and 7, there is a base frame 2 which is mounted on the bed or flat top 101 of a truck of lorry 102 which has integral lifting tackle 103 in the form of a crane which can be operated by the driver 104 for mounting and demounting a reel 3 onto which the hose 105 is wound on retrieval and from which it is unwound during laying or paying out.

The device 100 operates in a similar way to that described in FIGS. 1–5*c*, and has roller box arms 15 and 16, the feeding in roller box arm 15 having two forwardly inclined (as considered in the normal direction of forward motion of the lorry) rollers 15' and three tensioning rollers 15" round which the hose 105 is trained prior to being wound onto the reel 3, there being two forward rollers 15" lying in a plane transversely of the lorry 102 and a third roller 15" in a transverse plane spaced rearwardly of the plane of the first two and positioned intermediate the forward two rollers 15".

The box arm 16 for paying out the hose is similar to that of the first illustrated embodiment.

In use the reel 3 is mounted on the drive plate 7 as described previously, with one operator 104 such as the driver of the lorry, using the crane 103. When an empty reel 3 is mounted, as shown in FIG. 6, it can be used as before to retrieve a laid hose 105 by picking up the proximal end of the hose 1, passing it through the rollers 15', 15" and securing it to the reel 3 and then rotating the reel 3 in a winding in direction and driving the lorry 102 forward at a rate so as not to overrun the hose so that it is picked up or retrieved and is wound onto the reel. When the whole hose has been retrieved, the reel 3 can be lifted off the lorry by the operator 104, with the aid of the crane 103.

In all the embodiments, the drive plate 7 has protruding rollers (not shown) to produce turning of the reel 3, the rollers being operative to run over a boundary flange of the reel to facilitate turning of the reel. In each embodiment, the reel is dropped over the mushroom head, and turned back to secure the head 6 of the mushroom behind the flange 12, and as this action takes place, a stop moves out of the plate under pressure of a biassing means to lock the reel in position.

Although not described in detail, the hydraulic system will, it will be understood, be adapted for operating a hydraulic clutch for the reel paying out and retrieval system.

Moreover, it will be understood that other modifications may be incorporated without departing from the scope of the invention. Thus although two paying out and retrieval arms 15 and 16 have been described, a single arm fulfilling both functions may be used, in other words a single arm may be used for both paying out and retrieving of the hose.

The hose tensioning roller(s) may be mechanically operated and may therefore be adjustable, and may also be linked operatively with the hydraulic system whereby to control the hose tension.

Moreover, the pins or spigots 5 (and associated orifices 4) may be more or less than the three described, for example there may be four.

There may also be provided any kind of appropriate braking means for the reel or device, such as a caliper/-disc brake.

We claim:

1. A device for handling an elongate flexible member, comprising:

a reel device adapted to pay out and retrieve an elongate flexible member;

mobile carrier means for transporting the reel device;

mounting means whereby the reel device is mountable on and demounted from said carrier means;

separate means adapted to pay out and retrieve the elongate flexible member off from and on to said reel device, each said means being mounted on the carrier means laterally thereof, said separate means each including (i) an arm projecting substantially horizontally at an angle to a direction of motion of said carrier means, said arm having a proximate fixed end and a distal free end; and (ii) a plurality of roller means mounted adjacent the free end of the respective arms, an axis of rotation of some of the roller means of said plurality of roller means being substantially at 90° to the axis of rotation of others of said roller means of said plurality of roller means to provide a smooth passage of said member through said roller means to and from said reel device.

2. A device as defined in claim 1, further comprising motor means adapted to rotate the reel device in a desired operating direction.

3. A device as defined in claim 2, wherein the mounting means comprises spigot means on part of said carrier means and socket means in part of said reel device and wherein said spigot means is mounted on a drive device for powered operation of the reel device.

4. A device according to claim 3, wherein the drive device comprises a plate driven by a motor which is mounted on the carrier.

5. A device as defined in claim 1, wherein the mounting means comprises spigot means on part of said carrier means and socket means in part of said reel device.

6. A device as defined in claim 5, wherein the spigot means comprises three spaced apart spigots with enlarged heads and wherein the socket means comprises orifices in which the heads at least are receivable.

7. A device as defined in claim 1, wherein one of the roller means is a driven roller.

8. A device as defined in claim 1, wherein one of the roller means is a driven roller and wherein one of the rollers comprises a tensioning roller.

9. A device as defined in claim 1, wherein the retrieval means comprises a plurality of adjustable roller means.

10. A device as defined in claim 1, mounted on a chassis which is adapted to be drawn by a towing vehicle.

11. A device as defined in claim 1, mounted on a truck.

12. A device for handling an elongate flexible member, comprising:

a reel device adapted to pay out and retrieve an elongate flexible member;

mobile carrier means for transporting the reel device in a direction substantially longitudinal to said carrier means;

mounting means whereby the reel device is mountable on and demounted from said carrier means; and first and second means spaced apart along a longitudinal direction of said mobile carrier means and adapted to pay out and retrieve the elongate flexible member off from and on to said reel device, each said means being mounted on the carrier means laterally thereof, said separate means each comprising:

(i) an arm projecting substantially horizontally and at right angles to a direction of motion of the carrier means, said arm having a proximate end fixed to said carrier means and a distal free end extending outside a lateral extent of said mobile carrier means for a predetermined distance; and (ii) a plurality of roller means mounted on said free end of a respective one of said arms positioned outside said lateral extent of said carrier means.

* * * * *